US006263182B1

(12) United States Patent
Baker et al.

(10) Patent No.: US 6,263,182 B1
(45) Date of Patent: Jul. 17, 2001

(54) FUSER OIL DISPENSER FOR AN IMAGE FORMING APPARATUS

(75) Inventors: Raymond Milton Baker, Lexington; Ronald Paul Bussiere, Richmond; John William Hutchinson, Lexington; David Thomas Shadwick, Versailles, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/567,183

(22) Filed: May 9, 2000

(51) Int. Cl.[7] ..... G03G 15/20
(52) U.S. Cl. ..... 399/325
(58) Field of Search ..... 219/216; 399/45, 399/67, 324, 325

(56) References Cited

U.S. PATENT DOCUMENTS

| | | | | |
|---|---|---|---|---|
| 4,054,380 | | 10/1977 | Donohue et al. . | |
| 4,182,263 | * | 1/1980 | Naeser et al. | 399/325 |
| 4,231,653 | | 11/1980 | Nagahara et al. . | |
| 4,309,957 | | 1/1982 | Swift . | |
| 4,359,963 | | 11/1982 | Saito et al. . | |
| 4,429,990 | | 2/1984 | Tamary . | |
| 4,870,446 | * | 9/1989 | Bickerstaff et al. | 399/325 |
| 4,924,271 | | 5/1990 | Brinton et al. . | |
| 5,047,809 | | 9/1991 | Owada et al. . | |
| 5,049,943 | | 9/1991 | Menjo et al. . | |
| 5,160,970 | | 11/1992 | Isogai . | |
| 5,212,527 | | 5/1993 | Fromm et al. . | |
| 5,221,948 | | 6/1993 | Dalal . | |
| 5,270,740 | | 12/1993 | Naruse et al. . | |
| 5,327,204 | | 7/1994 | Sculley et al. . | |
| 5,353,107 | * | 10/1994 | Sculley et al. | 399/325 |
| 5,493,375 | | 2/1996 | Moser . | |
| 5,592,275 | | 1/1997 | Echigo et al. . | |
| 5,625,859 | | 4/1997 | Moser . | |
| 5,708,914 | * | 1/1998 | Mills et al. | 399/45 |
| 5,732,317 | | 3/1998 | Orchard II et al. . | |
| 5,749,036 | | 5/1998 | Yoda et al. . | |
| 5,800,908 | | 9/1998 | Hobson et al. . | |
| 5,835,831 | | 11/1998 | Staudenmayer et al. . | |
| 5,835,833 | | 11/1998 | Dalal et al. . | |
| 5,854,645 | | 12/1998 | Witteveen et al. . | |
| 5,937,257 | | 8/1999 | Condello et al. . | |
| 5,943,542 | | 8/1999 | Dalal et al. . | |
| 5,974,293 | | 10/1999 | Fromm . | |

* cited by examiner

*Primary Examiner*—Arthur T. Grimley
*Assistant Examiner*—Hoang Ngo
(74) *Attorney, Agent, or Firm*—Coats & Bennett, PLLC

(57) ABSTRACT

An image forming apparatus having a pair of fuser rollers for fusing toner onto the surface of recording sheets. The apparatus further includes an oil applicator mounted for dispensing oil onto at least one of the fuser rollers. The oil applicator includes a tank for holding oil, a pad disposed adjacent to one of the rollers for applying oil thereto, and an oil reservoir mounted adjacent the pad and connected to the tank for receiving oil therefrom. The oil reservoir includes an ejection port that permits oil within the reservoir to be dispensed to the pad. A flexible diaphragm extends over at least a portion of the oil reservoir, and a seal is secured to the diaphragm. At least one piezo element is secured to the diaphragm for moving the diaphragm and seal between two positions in response to the piezo element being selectively operable between engaged and non-engaged states. In one of the positions the seal effectively closes the oil reservoir ejection port, while in the other position the seal is spaced from the ejection port such that oil may flow from the oil reservoir through the ejection port and to the pad.

24 Claims, 5 Drawing Sheets

FUSER OIL DISPENSER FOR AN IMAGE FORMING APPARATUS

FIELD OF THE INVENTION

The present invention is directed to an electronically controlled oil dispenser for an image forming apparatus and, more particularly, to an oil dispenser having a piezo element for distributing oil to a roller within the image forming apparatus.

BACKGROUND OF THE INVENTION

The printing process of an image forming device, such as a laser printer, includes distributing toner to a recording sheet. The toner is usually a fine powder made of plastic granules that is transferred from a photoconductive drum, or intermediate transfer device, to the recording sheet. The toner is then fixed to the recording sheet by applying heat and/or pressure. In one popular embodiment, the heat and/or pressure is applied through a pair of fuser rollers that are spaced a distance apart between which the recording sheet and toner pass.

Problems may occur when the recording sheet with toner passes through the fuser rollers. One problem occurs when the toner on the recording sheet adheres to one of the fuser rollers resulting in image contamination as the toner does not adhere to the correct location on the recording sheet, or remains on the roller and is not transferred to the recording sheet. Another problem occurs when the recording sheet is inadvertently wound around one of the fuser rollers causing a jam.

To overcome these problems, oil is applied to one or both of the fuser rollers. The oil reduces the amount of toner that adheres to the rollers, and also lessens the likelihood of the recording sheet becoming entangled. An oil applicator is positioned adjacent to the rollers for distributing the oil. However, the application of oil to the fuser rollers may result in additional problems.

One problem is inconsistent oil transfer to the rollers during the life of the oil applicator. Many designs result in an over-abundance of oil being transferred to the fuser roller early in the life of the applicator. Too much oil distributed onto the rollers may be transferred to the recording sheet resulting in oil spots that are visible to the user thereby ruining the sheet. Conversely, the same applicators often do not apply an adequate amount of oil during the end of their life. Inadequate oil results in toner adhering to the fuser rollers and/or the recording sheet sticking to the fuser rollers, both of which are unacceptable results. Inconsistent oil application also makes it difficult to predict the expected life of the oil applicator.

Many currently existing oil applicators are messy to install and remove from the image forming device. One common design features a pad through which oil is applied and then wicked to the fuser rollers. Installation of this type of applicator may require that the pad be doused with oil during the installation which may result in oil contacting the user and also portions of the image forming device which may then be transferred to the recording sheet. Removal of a used oil applicator may again be messy as the oil applicator may be coated with oil that was dispelled during use. The oily applicator may inadvertently contact other parts of the image forming device or get on the user's hands or clothes.

Therefore, there is a need for an oil applicator that coats the fuser roller with a consistent amount of oil during its life, and is not messy to install and remove from the image forming apparatus.

SUMMARY OF THE INVENTION

The oil applicator of the present invention distributes oil to one of the fuser rollers to reduce and eliminate toner adherence and sheet jams within the rollers. The device includes an oil reservoir for housing the oil with at least one ejection port positioned within the reservoir. A seal is disposed adjacent to the ejection port and is movable between a closed position where the seal effectively closes the ejection port and an open position where the seal is spaced from the outlet such that oil may flow through the ejection port. At least one piezo element is positioned for moving the seal between the open and closed positions in response to the piezo element being switched between energized and non-energized states.

The applicator may also include a diaphragm that extends over at least a portion of the oil reservoir. In this embodiment, both the seal and piezo element are secured to the diaphragm. A pad may be disposed adjacent to the ejection port of the oil reservoir to receive oil and transfer it to the roller.

A processor may control the activation of the piezo element such that a substantially equal volume of oil is dispensed through the ejection port for each cycle between the energized and non-energized states. The processor may be connected to a voltage source for supplying voltage to and activating the piezo element. The processor may also monitor the number of recording sheets passing through the fuser rollers and cycle the piezo elements based on the number. For example, the processor may cycle the piezo element to distribute oil after every five recording sheets have passed through the rollers. Likewise, a sensor may be positioned within the image forming apparatus for sensing the installation of a new oil applicator. The sensor signals the processor of the new applicator, resulting in the processor cycling the piezo elements a predetermined number of times to ensure an adequate oil supply is distributed to the rollers.

The applicator may also include a supply tank for holding an additional amount of oil. The supply tank is connected to the oil reservoir and supplies the oil, preferably via gravity.

The oil reservoir may further include a number of individual cells each having at least one ejection port. A separate piezo element may be positioned over each of the cells for controlling the distribution of oil. Each piezo element may be individually energized to control the location of where the oil is distributed to the roller.

The invention also includes a method of dispensing oil from the oil reservoir by energizing a piezo element thereby opening an ejection port within the oil reservoir. The oil flow is stopped by de-energizing the piezo element thereby closing the ejection port within the oil reservoir. Within the method, energizing the piezo element moves a seal from a closed position over the ejection port, and de-energizing the piezo element returns the seal to the closed position.

DETAILED DESCRIPTION OF THE INVENTION

Figure 1:
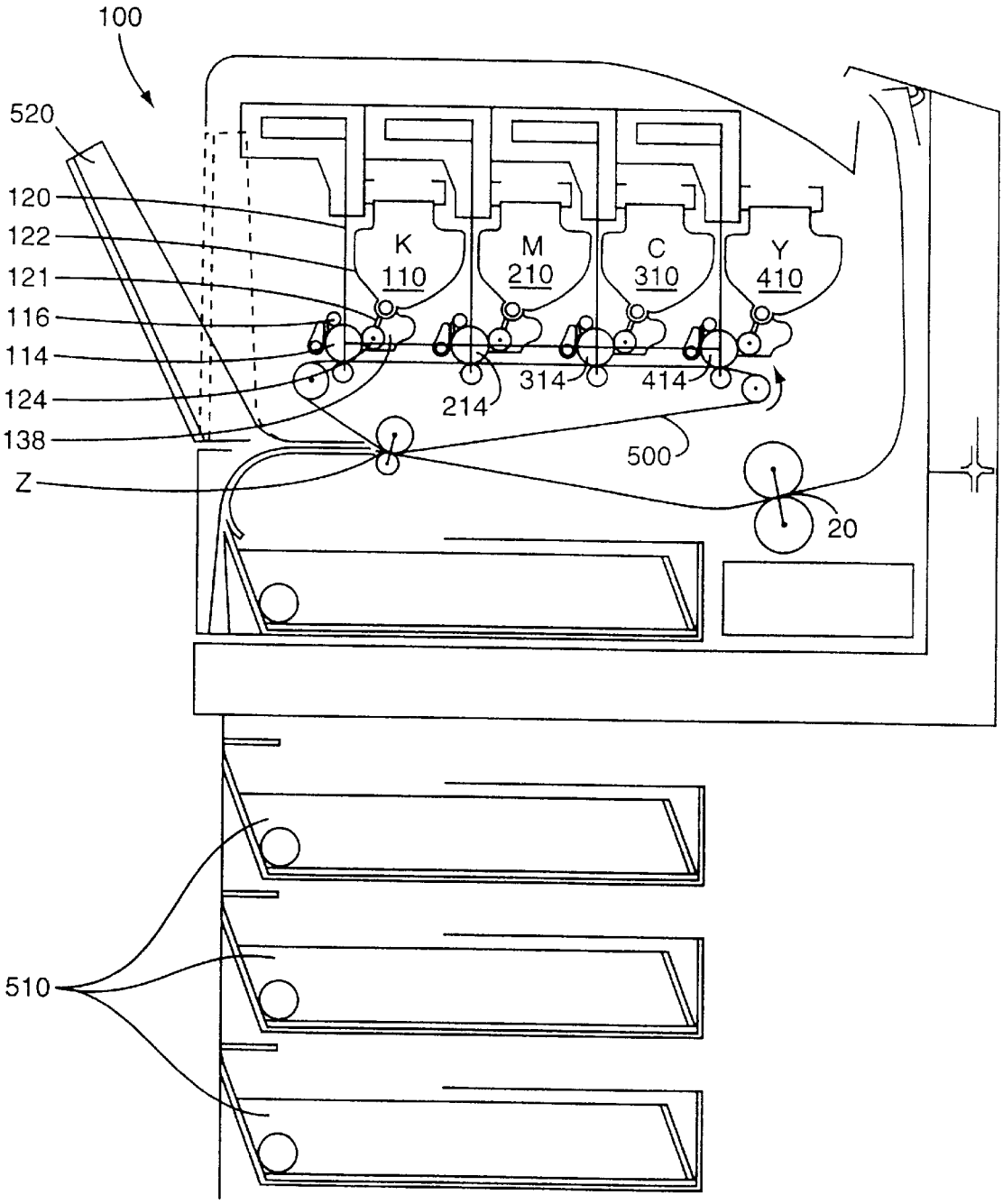
FIG. 1 is a side cross sectional view of an image forming apparatus constructed in accordance with the present invention.

The present invention, generally designated 10 in FIG. 2, is directed to a oil applicator and method of supplying oil to at least one of the fuser rollers 20 of an image forming apparatus 100. The invention includes an oil applicator 10 having a supply tank 29 for housing oil that is supplied to a pump 31. The pump 31 includes at least one piezo element 39 that is selectively movable between energized and non-energized states for dispensing oil to the fuser rollers 20.

FIG. 1 illustrates the basic elements of an image forming device and is incorporated for an understanding of the overall electrophotographic image forming process. A color laser printer is illustrated as 100, however, one skilled in the art will understand that the present invention is applicable to other types of image forming devices using toner for printing through a photoconductive drum. The image forming apparatus 100 includes a plurality of similar toner cartridges 110, 210, 310, and 410. Each toner cartridge has a similar construction but is distinguished by the toner color contained therein. In one embodiment, the image forming apparatus includes a black cartridge 110, a magenta cartridge 210, a cyan cartridge 310, and a yellow cartridge 410. The different color toners form individual images of a single color that are combined in layered fashion to create the final multi-colored image. Alternatively, the apparatus 100 may include a single cartridge for monochromatic images. As the individual cartridges are identical except for the toner color, the cartridge for forming black images will be described with an understanding that the other cartridges employed within a multi-color image forming apparatus would be substantially similar in both construction and function.

A photoconductive drum 114 is generally cylindrically-shaped having a smooth surface for receiving an electrostatic charge over the surface as the drum rotates past charging roller 116. The drum rotates through a laser imaging device 120 that directs a laser onto a selected portion of the drum surface forming an electrostatically latent image across the width of the drum representative of the outputted image. This process continues as the entire image pattern is formed on the drum surface.

After receiving the latent image, the drum rotates through a developer housing 122 having a toner bin for housing the toner and a developer roller 124 for uniformly transferring toner to the drum 114. The toner is a fine powder usually constructed of plastic granules that are attracted and cling to the electrostatic latent image formed by the laser imaging device 120.

Drum 114 next rotates past an adjacently positioned intermediate transfer medium belt 500 (hereinafter, ITM belt) where the toner is transferred from the drum 114. As illustrated in FIG. 1, the ITM belt 500 is endless and extends around a series of rollers adjacent to the drums. The ITM belt 500 and the image on each drum 114, 214, 314, 414 are synchronized providing for the toner from each drum to precisely align on the ITM belt during a single pass. By way of example as viewed in FIG. 1, the yellow (Y) toner will be placed on the ITM belt, followed by cyan (C), magenta (M), and black (B).

As the drums are being charged and gathering toner, a recording sheet 60, such as a sheet of paper, is being routed to intercept the ITM belt 500. The recording sheet 60 may be placed in one of the lower trays 510, or introduced into the image forming device through a side track tray 520. A series of rollers and belts (not illustrated) transports the recording sheet 60 to point Z where the sheet contacts the ITM belt 500 and the toner is transferred. The sheet 60 and attached toner next travel through a pair of fuser rollers 20 that includes a heating element that heats and fuses the toner to the sheet. The sheet 60 with fused image is then transported out of the image forming apparatus 100.

Figure 2A:
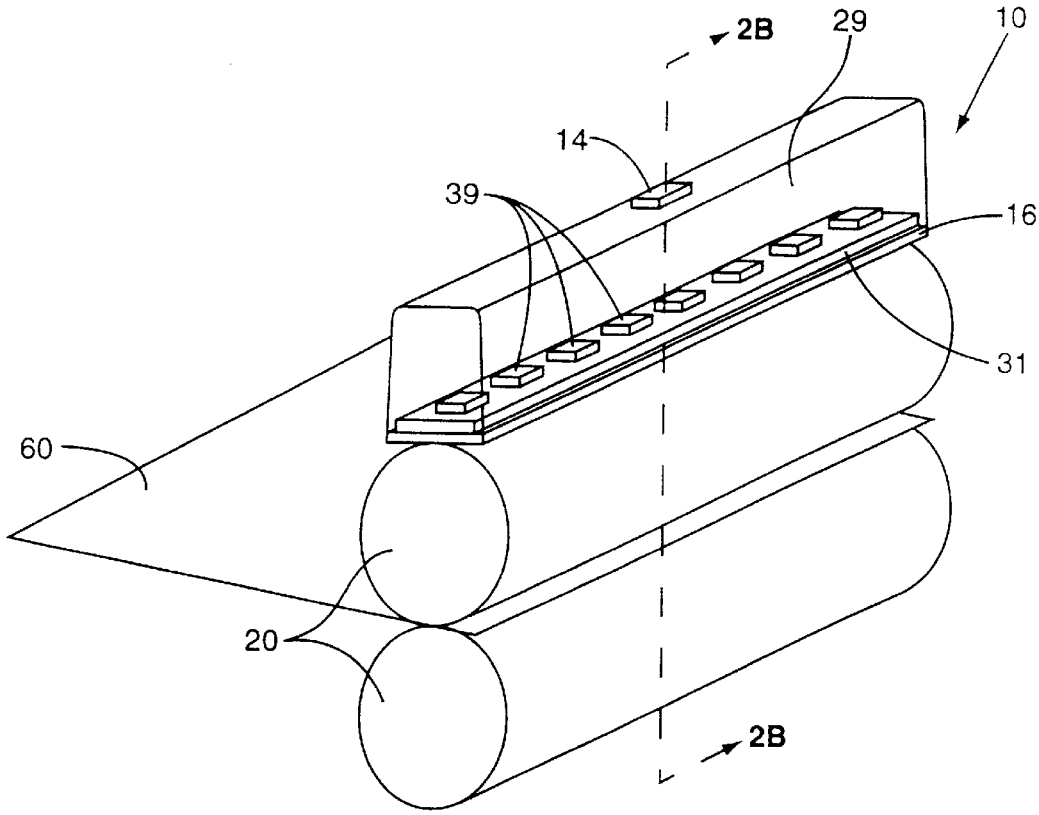
FIG. 2A is a perspective view of the fuser rollers and adjacent oil applicator.

FIG. 2A illustrates the oil applicator 10 placed adjacent to one of the fuser rollers 20. Each of the fuser rollers 20 may have a variety of diameters, and the two may not have the same diameter roller. The length of each fuser roller 20 is preferably about equal to the width of the recording sheet 60 to fuse the toner along the entire sheet width. Preferably, the rollers 20 have a substantially smooth surface to lessen the likelihood of toner adherence and of the recording sheet 60 becoming jammed. In a preferred embodiment, one of the rollers 20 contains a heating element for improving the bond between the toner and the recording sheet 60. Usually, the heating element is contained within the top roller that contacts the toner on the surface of the recording sheet 60.

Figure 2B:
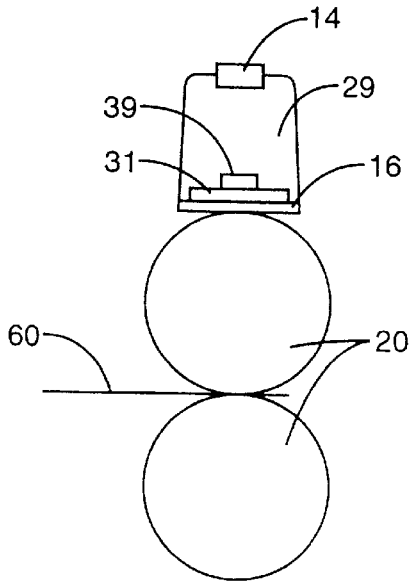
FIG. 2B is a side view taken along line 2B—2B of FIG. 2A.

The oil applicator 10 is positioned against one of the fuser rollers 20 as illustrated in FIGS. 2A and 2B and functions to supply oil across the length of the fuser roller 20. The oil applicator 10 includes a supply tank 29 for housing oil that is to be distributed to a pump 31 through a supply line 12 illustrated in FIG. 3. When the oil applicator 10 is mounted within the image forming apparatus 100, the supply tank 29 is preferably positioned vertically above the pump 31 such that oil can feed into the pump 31 through the supply line 12 via gravity. The oil supply line 12 is preferably positioned within walls of the oil applicator for containing the oil and preventing any possible leakage. A vent 14 may be positioned on the oil applicator 10 for venting air into the applicator for consistent oil flow. The vent 14 preferably includes a one-way check valve constructed such that oil cannot leak out if the oil applicator 10 is inverted such as during shipping, installation, or removal.

Figure 3:
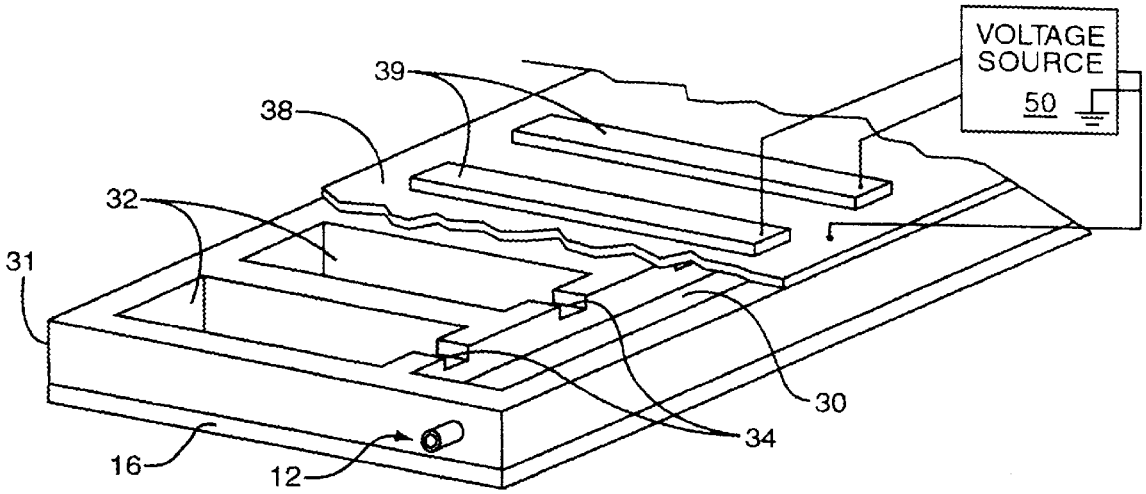
FIG. 3 is a partial perspective view of the oil applicator pump constructed in accordance with the present invention.
Figure 4A:
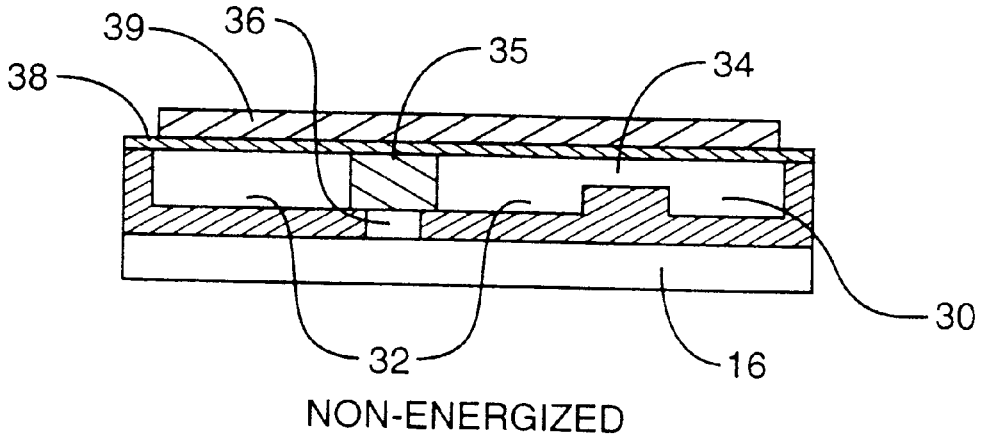
FIG. 4A is a side view of a cell reservoir in a relaxed, non-energized orientation.
Figure 4B:
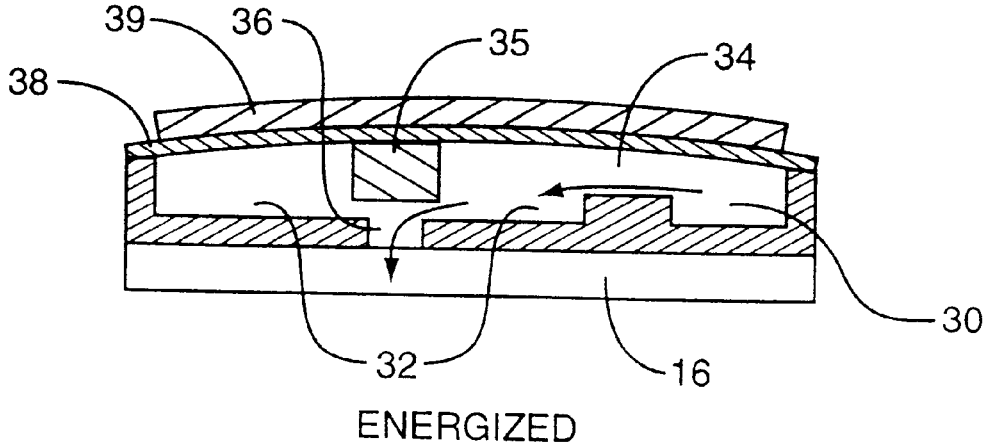
FIG. 4B is a side view of the cell of FIG. 4A in an energized orientation.

FIG. 3 illustrates the interior sections of the pump 31 within the oil applicator 10. The pump 31 includes a distribution channel 30 extending along the length of the pump for distributing oil throughout the applicator. A plurality of cell reservoirs 32 are positioned in proximity to the distribution channel 30. The cell reservoirs 32 and distribution channel 30 are separated by inlets 34 through which the inflow of oil into the reservoirs is controlled. As illustrated in FIGS. 4A and 4B, an ejection port or outlet 36 is positioned within each cell reservoir 32 for distributing oil to the fuser roller 20. Although only one ejection port 36 is illustrated within each cell reservoir 32, there may be any number of ports positioned within each reservoir.

The oil applicator 10 includes a membrane or diaphragm 38 positioned over the pump 31 as illustrated in FIGS. 3, 4A and 4B. The diaphragm 38 extends across the oil applicator 10 and is sealed to pump side walls. The diaphragm is constructed of a flexible material such that it may move between energized and non-energized states as illustrated in FIGS. 4A and 4B. The flexing of the diaphragm 38 also assists in pumping oil through the distribution channel 30, into the cell reservoirs 32, and out through the ejection ports 36.

A seal 35 is positioned within the cell reservoir 32 for controlling the flow of oil through the ejection port 36. The seal 35 is attached to the diaphragm 38 and reciprocates over the ejection port 36 during the cycles of the energized and non-energized states. The seal 35 is sized to cover the ejection port 36 and prohibit the flow of oil from the cell reservoir 32 in the non-energized state as illustrated in FIG. 4A. In the energized state, the diaphragm 38 and attached seal 35 move away from the cell reservoir 32 and the seal moves from the ejection port 36 allowing for oil to exit as illustrated in FIG. 4B.

At least one piezo element 39 is attached to the diaphragm 38 and is selectively movable between energized and non-energized states. The piezo-elements are connected to a voltage source 50 to apply a sinusoidal or pulsed voltage. In the energized state, voltage is applied causing the piezo-element 39 to expand resulting in the element deflecting as illustrated in FIG. 4B. The attached diaphragm 38 and seal 35 are also moved thereby opening the ejection port 36. When the voltage is removed from the piezo element 39, it contracts to the original position thereby returning the diaphragm 38 and seal 35 and closing the ejection port 36. Preferably, the voltage across the piezo-element is between about one and fifty volts, dependent upon the thickness of the element, the rigidity of the diaphragm 38, the dimensions of the cell reservoir 32, and the physical characteristics of the oil. The diaphragm 38 is preferably constructed of a conductive material and is a common electrical contact to the piezo elements 39, and is connected to a grounding element such as the negative terminal of the voltage source 50. The use of piezo-elements is well known in the art for ejecting ink within an inkjet printer, such as that disclosed in U.S. Pat. Nos. 5,270,740 and 5,854,645 both of which are herein incorporated by reference in their entirety.

Preferably, a separate piezo-element 39 is positioned over each cell reservoir 32 for separately controlling the output of oil from each reservoir. Each piezo-element 39 is connected to the voltage source 50 for individual actuation thereby allowing for oil to be ejected from the cell reservoirs 32. Alternatively, a single piezo element 32 may be positioned over the diaphragm 38 such that when a voltage is applied, oil is output from each ejection port 36 along the oil applicator 10.

A pad 16 is positioned adjacent to the ejection ports 36 for receiving oil from the applicator 10 and transferring it to the fuser roller 20. The pad 16 is constructed of a material causing a wicking action when oil is applied for distributing the oil through the pad. Because the pad 16 contacts the fuser roller 20, it may also remove debris such as paper dust and toner. Additionally, the pad 16 may have more than one layer, and each layer may have a different construction depending upon the specific requirements of the oil application. Pads for wicking oil along the length of the fuser roller are well known in the art. See, for example, U.S. Pat. Nos. 4,182,263; 4,309,957; and 4,359,963, each of which is expressly incorporated herein by reference in their entirety.

Figure 5:
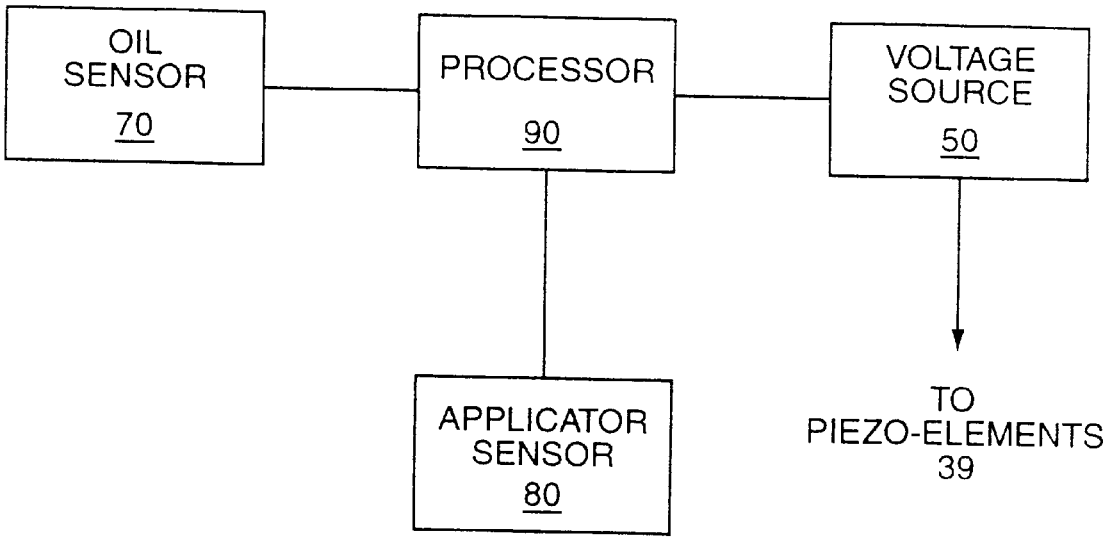
FIG. 5 is a schematic diagram illustrating a processor for controlling the oil applicator.

FIG. 5 illustrates a schematic representation of a processor 90 that monitors the workings of the oil applicator 10. Processor 90 may include a conventional memory unit such as a ROM, PROM or flash memory accessible for storing a program controlling the functioning of the oil applicator 10. Additionally, the processor 90 includes logic for determining the number of recording sheets 60 passing through the fuser rollers 20. Various processors for controlling the functioning of components of the image forming apparatus are well known in the art, including U.S. Pat. Nos. 4,054,380 and 5,749,036, both incorporated herein by reference in their entireties.

The processor 90 is operatively connected with a voltage source 50 for controlling the cycling of the piezo element 39 and distribution of oil through the ejection port 36. An oil sensor 70 is positioned in proximity to the oil applicator 10 for detecting the amount of oil being applied to the fuser roller 20. In one embodiment, the oil sensor 70 determines the amount of oil on the fuser roller 20 by directing a light source onto the fuser roller and determining the amount of reflected light. This determination is sent to the processor 90 which then distributes oil as needed. The oil applicator 10 may include a single oil sensor 70 for determining the amount of oil distributed to the roller 20, or may include more than one sensor positioned along the fuser roller 20.

An applicator sensor 80 may also be positioned within the image forming apparatus 100 to determine the installation of a new oil applicator 10. A new oil applicator 10 preferably includes a dry pad 16 that contains no oil 10. Therefore, when initially installed, the applicator sensor 80 signals the processor 90 which in turn signals the voltage source 50 to saturate the pad 16.

Each cycle of the piezo element 39 between the energized and non-energized states produces substantially the same amount of oil being dispensed from the ejection ports 36. This provides for the processor 90 to be preprogrammed such that an appropriate amount of oil is distributed to the fuser roller 20. By way of example, it may be determined that four cycles of oil should be distributed through each ejection port 36 for every ten recording sheets passing through the fuser rollers 20. Likewise, the amount of oil that should be dispensed for a new oil applicator 10, or the amount of oil based upon readings from the oil sensor 70 may also be stored in the processor 90. Knowing the amount of oil dispensed during each cycle allows for monitoring the expected life of the oil applicator 10. The processor may further be equipped with a signal light (not illustrated) visible to a user indicating when the oil applicator 10 currently in use should be replaced.

In use, the oil applicator 10 is mounted within the image forming device 100 such that oil from the supply tank 29 enters the pump 31 through the oil supply line 12. As illustrated in FIG. 4A, the seal 35 in the non-energized state is positioned to block oil flow through the ejection port 36. In FIG. 4B, the processor 90 signals the voltage source 50 to activate the piezo-element 39 to the energized state in which the seal is moved from the ejection port 36. Oil within the cell reservoir 32 moves into the ejection port 36, and additional oil is drawn from the distribution channel 30 into the cell reservoir. When the current is interrupted, the piezo-element 39, diaphragm 38, and seal 35 return to the relaxed orientation. This movement ejects oil from the ejection port 36 until the seal 35 closes. The contact of the seal 35 over the ejection port 36 stops the oil flow, and breaks the capillary action of the oil into the pad 16. Once distributed to the pad 16, the oil migrates through the pad and onto the fuser roller 20.

It is advantageous for containing the entire oil applicator 10 within a single device. When the oil is depleted, the user simply replaces the entire oil applicator 10. There is less of a likelihood that oil will inadvertently contact the user's hands or clothes. Additionally, there is less of a likelihood that oil will contact components of the image forming apparatus 100 which may eventually be transferred to an outputted recording sheet resulting in a printing defect. Replacing the entire oil applicator 10 also provides a more straight-forward program for the processor 90 to prime the pad 16 with oil when a new applicator is installed.

In the foregoing description, like-reference characters designate like or corresponding parts throughout the several views. Also, it is to be understood that such terms as "forward", "rearward", "left", "right", "upwardly", "downwardly", and the like are words of convenience that are not to be construed as limiting terms. Certain modifications and improvements will occur to those skilled in the art upon a reading of the foregoing description. In an alternative embodiment, the oil applicator 10 does not include a supply tank 29, but rather oil is pumped through the oil supply line 12 from a remote oil reservoir (not illustrated). In another alternative embodiment, the oil applicator 10 distributes the oil directly to the fuser roller 20 through the ejection ports 36 spaced along the roller length. This alternative embodiment does not include a pad 16. It should be understood that other modifications and improvements have been deleted herein for the sake of conciseness and readability but are properly within the scope of the following claims.

What is claimed is:

1. A device for distributing oil to a roller within an image forming apparatus comprising:

an oil reservoir with an ejection port therein;

a diaphragm extending over said ejection port;

a seal secured to said diaphragm and disposed adjacent said ejection port and movable between a closed position where the seal effectively closes said ejection port and an open position where the seal is spaced from the outlet port such that oil may flow through said ejection port; and at least one piezo element secured to said diaphragm for moving said seal between said open and closed positions in response to the said piezo element being switched between energized and non-energized states.

2. The device of claim 1, further including a pad disposed adjacent said ejection port of the oil reservoir for receiving oil therefrom.

3. The device of claim 1, further including a processor for controlling the activation of said piezo element such that a substantially equal volume of oil is dispensed through said ejection port in response to said piezo element cycling between said energized and non-energized states.

4. The device of claim 3, wherein said processor is driven by a voltage source and wherein said processor is operatively connected to said voltage source for activating said piezo element.

5. The device of claim 3, wherein said processor is preprogrammed to control the cycling of said piezo element as a function of the number of recording sheets that pass through the image forming apparatus.

6. The device of claim 3, further including an oil sensor for sensing the quantity of oil an oil on the roller, said processor being operatively connected to said oil sensor for cycling said piezo element when the quantity of oil is below a predetermined level.

7. The device of claim 1, further including a supply tank connected to said oil reservoir.

8. The device of claim 7, wherein oil from said supply tank is fed via gravity to said oil reservoir.

9. The device of claim 1, wherein said oil reservoir includes a plurality of cells each having at least one of said ejection ports for distributing oil.

10. The device of claim 9, wherein a separate piezo element is positioned over each of said cells and wherein each of said piezo elements may be individually cycled.

11. An image forming apparatus comprising:

a. a pair of fuser rollers for fusing toner onto recording sheets;

b. an oil applicator mounted adjacent to said fuser rollers for dispensing oil onto at least one of said fuser rollers, said oil applicator including:

(i) a tank for holding oil;

(ii) a pad disposed adjacent to one of said rollers for applying oil thereto;

(iii) an oil reservoir mounted adjacent said pad and connected to said tank for receiving oil therefrom, said oil reservoir including an ejection port that permits oil within said reservoir to be dispensed to said pad;

(iv) a flexible diaphragm extending over at least a portion of said oil reservoir;

(v) a seal secured to said diaphragm; and (vi) at least one piezo element secured to said diaphragm for moving said diaphragm and seal between two positions in response to said piezo element being switched between energized and non-energized states, and wherein in one of said positions said seal effectively closes said ejection port of said oil reservoir while in said other position said seal is spaced from said ejection port such that oil may flow from said oil reservoir through said ejection port and to said pad.

12. The apparatus of claim 11, wherein said tank includes a vent for venting air when distributing oil from said tank to said oil reservoir.

13. The apparatus of claim 11, wherein said diaphragm is connected to said oil reservoir along an outer wall, said diaphragm bows outward from said outer wall in said energized state.

14. The apparatus of claim 13, wherein said at least one piezo element is mounted on a first side of said diaphragm and said seal is positioned on a second side of said diaphragm.

15. The apparatus of claim 11, wherein said oil reservoir includes a plurality of cells for holding oil, each of said cells including at least one of said ejection ports.

16. The apparatus of claim 15, wherein said oil reservoir includes a distribution channel for distributing oil to each of said cell reservoirs.

17. The apparatus of claim 15, wherein a separate piezo element is positioned over each of said cell reservoirs for individually controlling the distribution of oil through each of said ejection ports.

18. The apparatus of claim 11, further including a processor for controlling the activation of said piezo element for dispensing oil through said ejection port.

19. The apparatus of claim 18, wherein said processor is connected to a voltage source for cycling said piezo element.

20. The device of claim 18, wherein said processor is preprogrammed to control said at least one piezo element, said processor being preprogrammed for distributing a predetermined amount of oil dependent upon the number of recording sheets passing through said pair of fuser rollers.

21. The device of claim 18, further including an applicator sensor operatively connected to said processor, said processor activating said at least one piezo element a preprogrammed number of cycles when said applicator sensor is activated.

22. A method of dispensing oil onto a roller within an image forming apparatus comprising:

a. directing oil into a reservoir and out of an outlet port therein onto the roller;

b. controlling the flow of oil out the outlet port by opening and closing the outlet port by repeatedly energizing and deenergizing a piezo element that is operative to move a seal back and forth between open and closed positions with respect to the outlet port; and c. wherein the seal and the piezo element are secured to a flexible diaphragm and wherein the piezo element deforms the diaphragm as it is cycled between energized and de-energized states, causing the seal to move back and forth between the open and closed positions.

23. A method of dispensing oil to a roller within an image forming apparatus comprising:

a) directing oil into a reservoir;

b) directing oil from the reservoir to the roller by periodically opening and closing an outlet port formed in the reservoir, the reservoir comprising a flexible diaphragm, a seal attached thereto, and a piezo element operatively connected to the flexible diaphragm to move the diaphragm between open and closed positions; and c) opening and closing the outlet port by moving the diaphragm between the open and closed positions with respect to the outlet port such that in the open position the seal is spaced from the outlet port allowing oil to pass through the outlet port while in the closed position the seal is disposed directly adjacent the outlet port so as to close the same.

24. The method of claim 23, wherein both the seal and the piezo element are secured to a flexible diaphragm and wherein the piezo element is operative to form the diaphragm as the piezo element is energized and de-energized, and wherein as the diaphragm is formed the seal is moved back and forth between its open and closed positions.

* * * * *